US011945554B2

(12) United States Patent
Chen

(10) Patent No.: US 11,945,554 B2
(45) Date of Patent: Apr. 2, 2024

(54) ARTIFICIAL FLOATING ISLAND

(71) Applicant: Kuang-Cheng Chen, Taichung (TW)

(72) Inventor: Kuang-Cheng Chen, Taichung (TW)

( * ) Notice: Subject to any disclaimer, the term of this patent is extended or adjusted under 35 U.S.C. 154(b) by 281 days.

(21) Appl. No.: 17/476,203

(22) Filed: Sep. 15, 2021

(65) Prior Publication Data

US 2022/0281567 A1 Sep. 8, 2022

(30) Foreign Application Priority Data

Mar. 5, 2021 (TW) ..... 110108002

(51) Int. Cl.
*B63B 35/44* (2006.01)
*B63B 35/38* (2006.01)

(52) U.S. Cl.
CPC ..... *B63B 35/44* (2013.01); *B63B 35/38* (2013.01); *B63B 2035/4493* (2013.01); *B63B 2221/22* (2013.01)

(58) Field of Classification Search
CPC ..... B63B 35/00; B63B 35/34; B63B 35/38; B63B 35/44
USPC ..... 114/264
See application file for complete search history.

(56) References Cited

U.S. PATENT DOCUMENTS 4,799,445 A * 1/1989 Meriwether ..... B63B 35/38 114/263

FOREIGN PATENT DOCUMENTS

CN 209974417 1/2020
JP 2008074297 4/2008

* cited by examiner

*Primary Examiner* — Lars A Olson
(74) *Attorney, Agent, or Firm* — Burris Law, PLLC

(57) ABSTRACT

An artificial floating island includes a lower mounting and an upper mounting. The upper mounting includes a bottom wall and a surrounding wall that cooperatively define an internal space. The surrounding wall has service openings and root through holes. The upper mounting has internal blocks, each having a block body that is connected between the bottom wall and the surrounding wall, and that defines a service space disposed outside of the upper mounting and being in communication with a respective one of the service openings. The lower mounting is coupled to the upper mounting and has an outer surface that is formed with a plurality of guiding troughs.

6 Claims, 13 Drawing Sheets

ARTIFICIAL FLOATING ISLAND

CROSS-REFERENCE TO RELATED APPLICATION

This application claims priority to Taiwanese Invention Patent Application No. 110108002, filed on the 5 Mar. 2021.

FIELD

The disclosure relates to an artificial floating island, and more particularly to an artificial floating island that can be combined to form an artificial floating island assembly.

BACKGROUND

A conventional artificial floating island includes an upper mounting and a lower mounting that can be assembled together. Additionally, a set of fasteners (nuts and bolts) are used to secure a fitting to the upper mounting and the lower mounting. Abroad variety of fittings may be used on the artificial floating island so that it may perform a variety of different functions depending on the type of fitting used. For example, the fittings of the artificial floating island may incorporate a filler material (such as soil) for the growing of plants, thereby allowing the artificial floating island to serve an ecological purpose. However, each time a new fitting is to be secured to the conventional artificial floating island, or an old fitting is to be replaced, the upper mounting and the lower mounting must first be disassembled, and then be assembled back together again after the fitting is installed. When assembling the upper mounting and the lower mounting, the nuts need to be placed at respective positions on the lower mounting, the upper mounting is then coupled to the lower mounting, and the respective bolts are then threadedly engaged to the respective nuts to complete the assembly of the conventional artificial floating island. Since the upper mounting and the lower mounting needs to be disassembled whenever attaching a new fitting or replacing an existing fitting, the conventional artificial floating island has a tedious assembly procedure.

SUMMARY

Therefore, an object of the disclosure is to provide an artificial floating island that can alleviate at least one of the drawbacks of the prior art.

Accordingly, an artificial floating island includes an upper mounting and a lower mounting. The upper mounting includes a bottom wall, an extension wall, a surrounding wall, and a plurality of internal blocks. The bottom wall is formed with a root opening. The extension wall extends downwards from a peripheral edge of the root opening of the bottom wall, and defines a root space that is in communication with the root opening. The surrounding wall extends upwards from a periphery of the bottom wall and cooperates with the bottom wall to define an internal space. The surrounding wall has a plurality of service openings. Each of the internal blocks has a block body that is connected between the bottom wall and the surrounding wall, and that defines a service space disposed outside of the upper mounting and being in communication with a respective one of the service openings.

The lower mounting is coupled to the upper mounting. The lower and upper mountings are arranged in an up-down direction. The lower mounting has an outer surface that is formed with a plurality of guiding troughs.

Another object of the disclosure is to provide an artificial floating island assembly that includes a plurality of the abovementioned artificial floating islands.

Accordingly, the artificial floating island assembly includes a plurality of the abovementioned artificial floating islands that are arranged in a first direction, and a connecting unit that includes a first board member extending in the first direction and removably connected to the artificial floating islands.

Another object of the disclosure is to provide an artificial floating island assembly that includes at least two groups of the abovementioned artificial floating islands.

Accordingly, the artificial floating island assembly includes at least two groups of the abovementioned artificial floating islands that are arranged in a first direction. Each group includes a plurality of the artificial floating islands that are arranged in a second direction transverse to the first direction. The artificial floating island assembly further includes a connecting unit that includes at least one first board member extending in the first direction, and at least one second board member extending in the second direction. The at least one first board member and the at least one second board member are removably connected to the at least two groups of the artificial floating islands.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
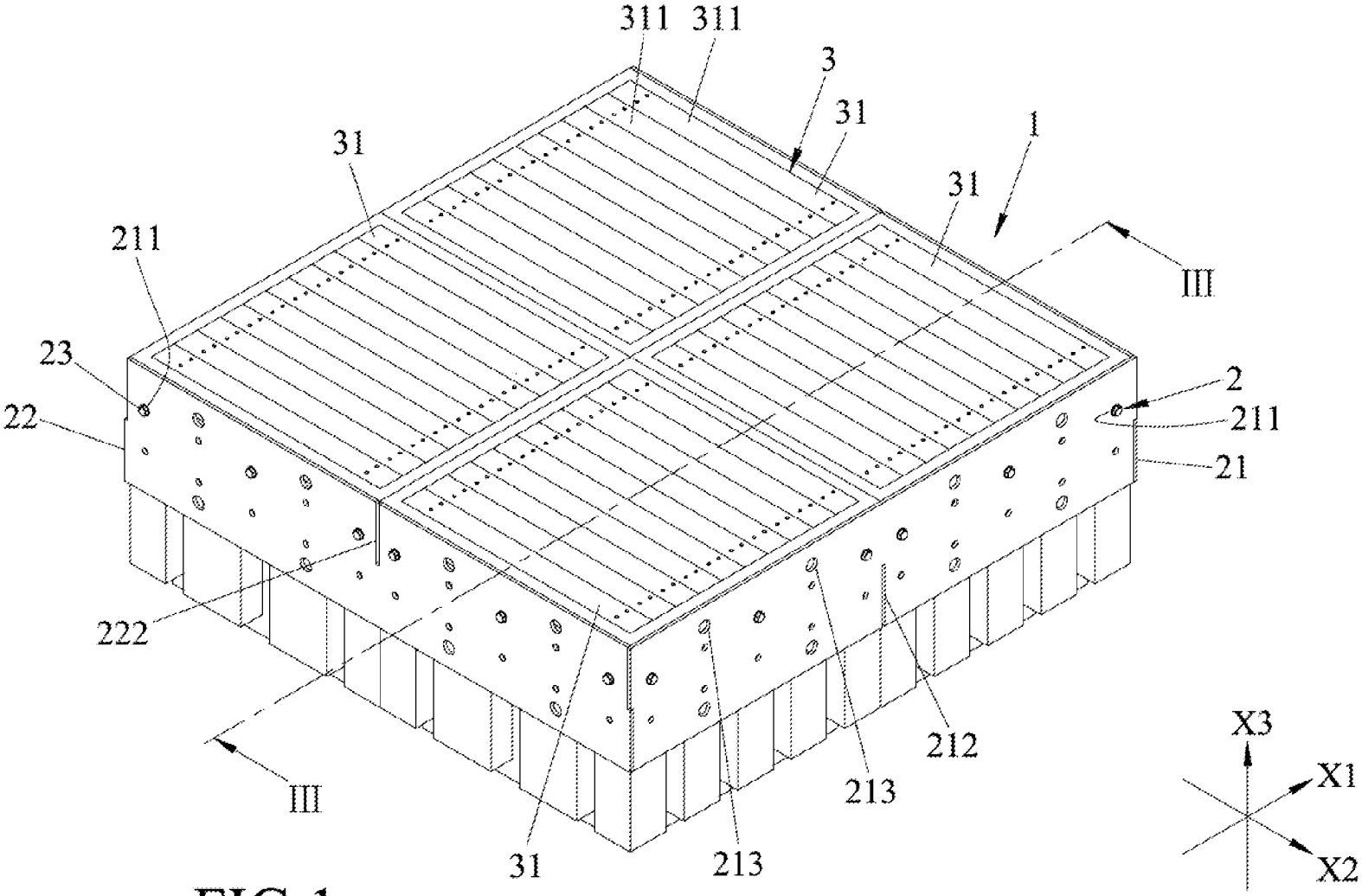
FIG. 1 is a perspective view illustrating a first embodiment of an artificial floating island assembly according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
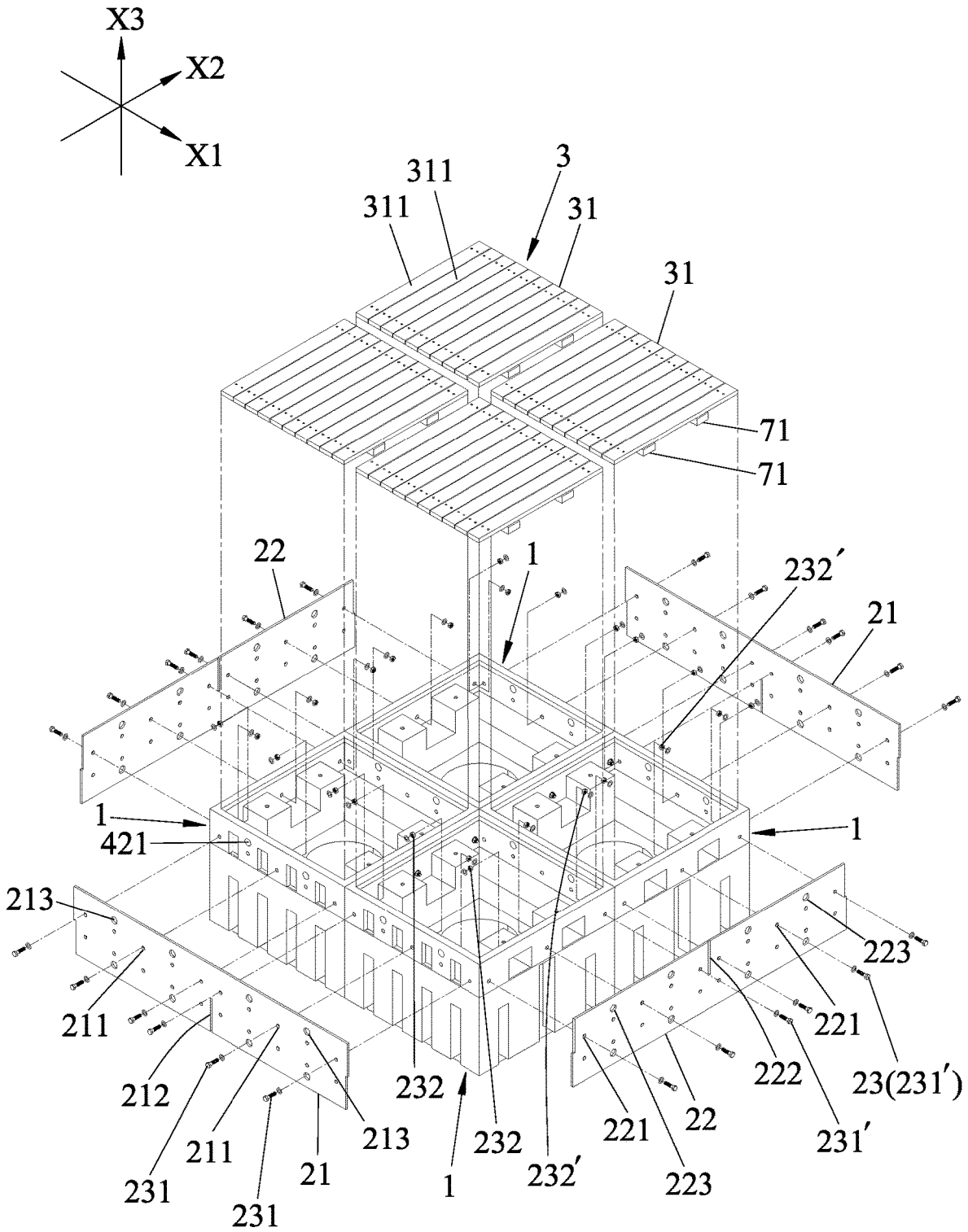
FIG. 2 is a partly exploded perspective view of the first embodiment.

FIGS. 1 and 2 show a first embodiment of an artificial floating island assembly according to the present disclosure. The artificial floating island assembly includes two groups of artificial floating islands 1, and a connecting unit 2. The two groups of the artificial floating islands 1 are arranged in a first direction (X1), and each group includes two artificial floating islands 1 that are arranged in a second direction (X2) transverse to the first direction (X1). In other words, the first embodiment of the artificial floating island assembly includes four artificial floating islands 1. In this embodiment, the first direction (X1) is perpendicular to the second direction (X2).

Since, the structures of the four artificial floating islands 1 are identical, only one artificial floating island 1 will be described in the following.

Figure 4:
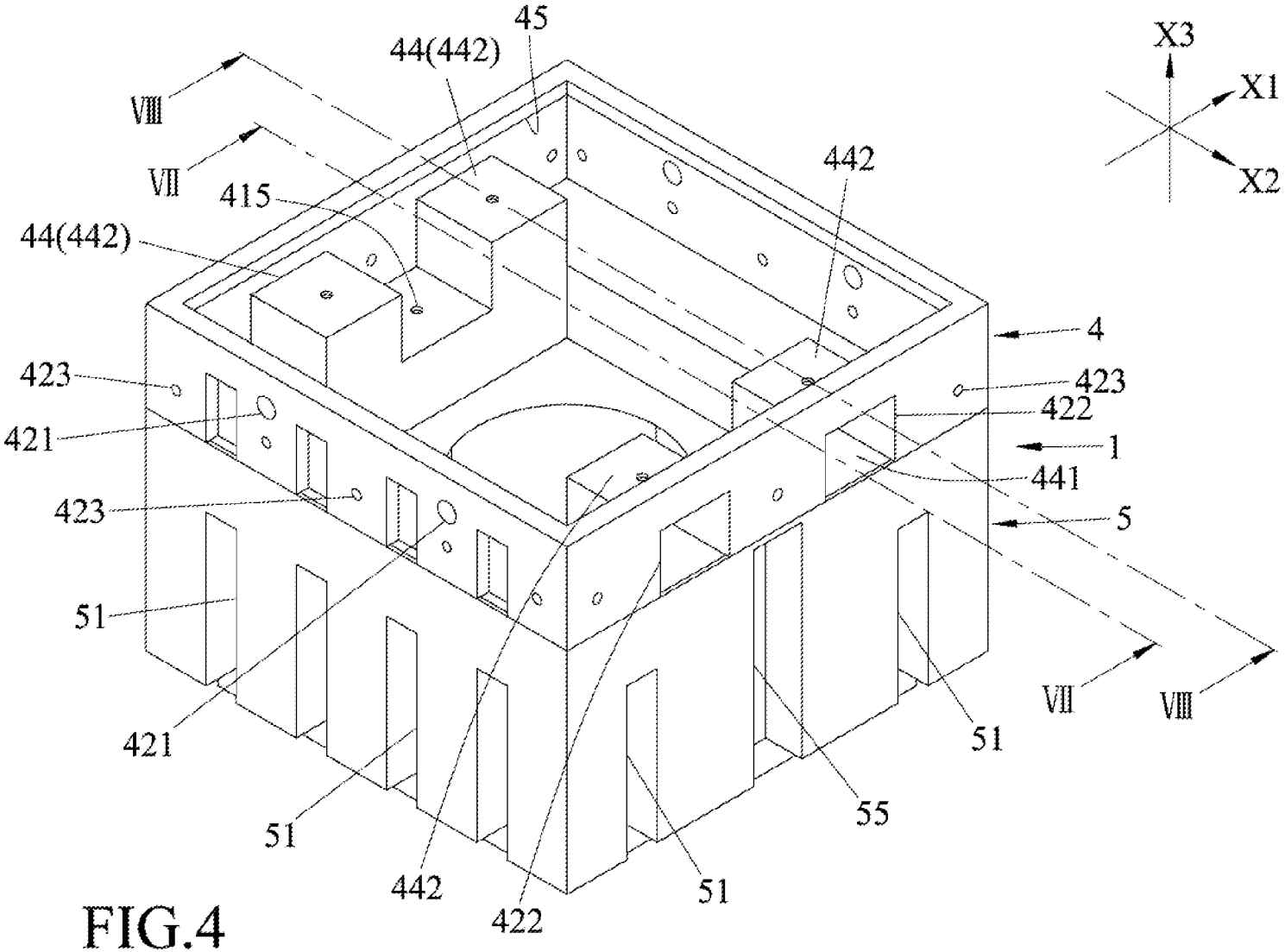
FIG. 4 is an assembled perspective view illustrating an upper mounting and a lower mounting of an artificial floating island of the first embodiment.
Figure 5:
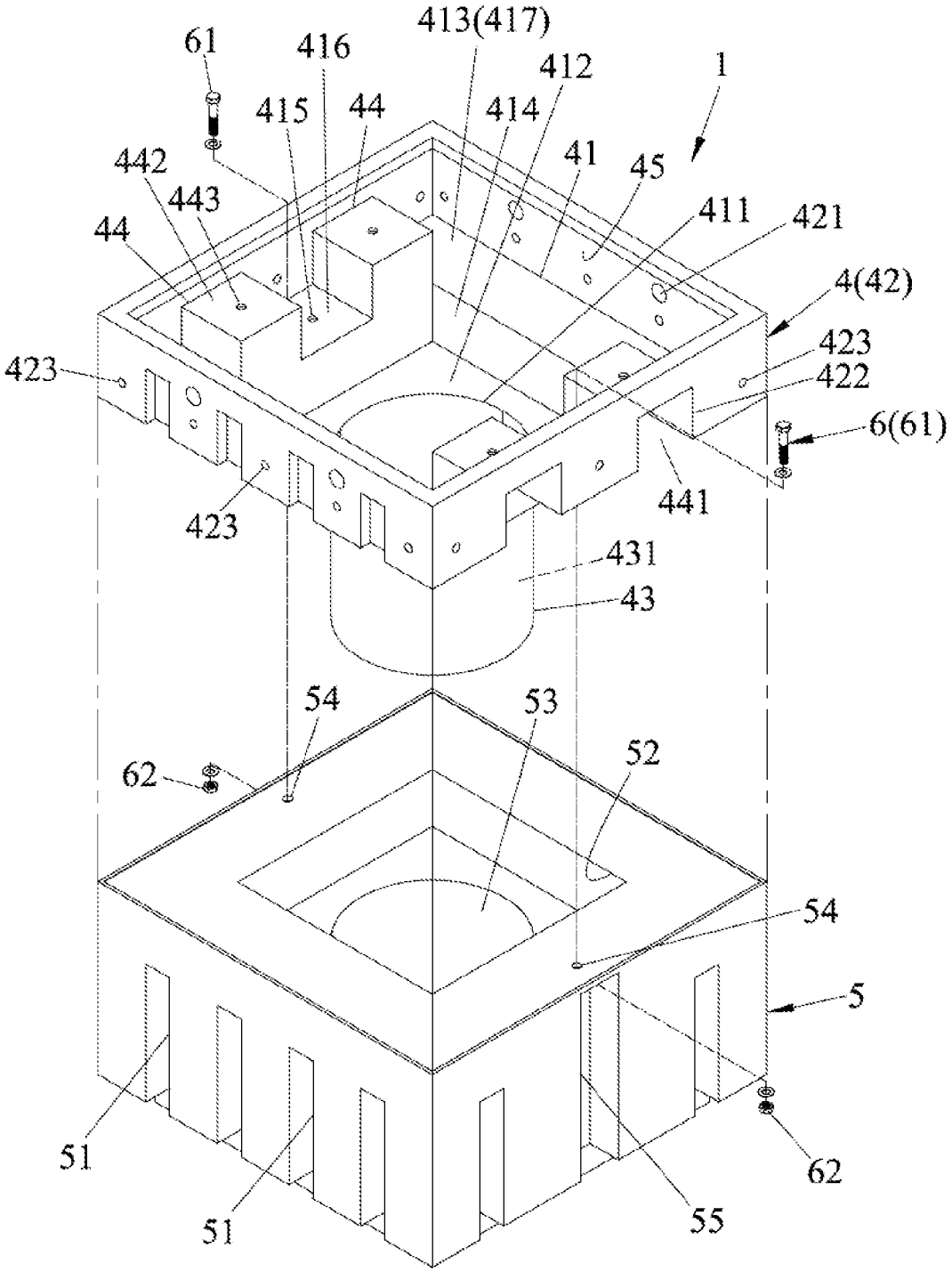
FIG. 5 is an exploded perspective view illustrating the upper mounting, the lower mounting, and a fastening unit of the artificial floating island of the embodiment.

Referring to FIGS. 4 and 5, the artificial floating island 1 includes an upper mounting 4 and a lower mounting 5. The upper mounting 4 includes a bottom wall 41 formed with a root opening 411, a surrounding wall 42 extending upwards from a periphery of the bottom wall 41 and cooperating with the bottom wall 41 to define an internal space 45, an extension wall 43 extending downwards from a peripheral edge of the root opening 411 of the bottom wall 41, and a plurality of internal blocks 44 that are connected between the bottom wall 41 and the surrounding wall 42. The surrounding wall 42 has a plurality of service openings 422, a plurality of root through holes 421, and a plurality of securing holes 423. The lower mounting 5 is coupled to the upper mounting 4. The upper and lower mountings 4, 5 are arranged in a third direction (X3) which is transverse to the first and second directions (X1, X2), and the lower mounting 5 has an outer surface that is formed with a plurality of guiding troughs 51. In this embodiment, the third direction (X3) is an up-down direction perpendicular to the first and second directions (X1, X2).

Figure 6:
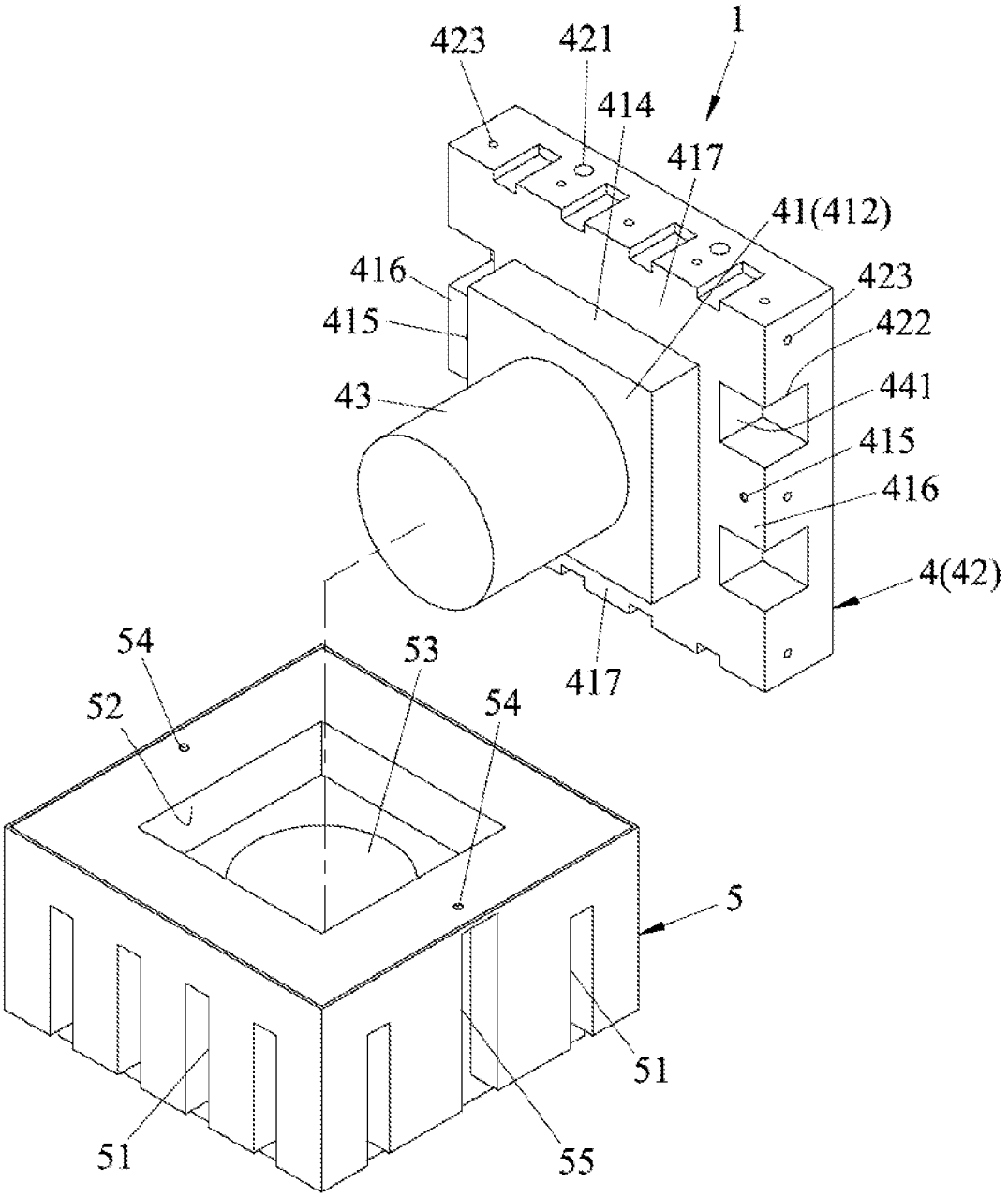
FIG. 6 is another exploded perspective view illustrating the upper mounting and the lower mounting of the artificial floating island of the embodiment.

Referring further to FIG. 6, in this embodiment, the bottom wall 41 has a first wall section 412 that is connected to a top end of the extension wall 43, a second wall section 413 that extends inwards from a bottom end of the surrounding wall 42 and that is above the first wall section 412 in the third direction (X3) (i.e., the up-down direction), and a shoulder section 414 that interconnects the first wall section 412 and the second wall section 413. The extension wall 43 defines a root space 431 that is in communication with the root opening 411.

The second wall section 413 of the upper mounting 4 has two long portions 417 and two short portions 416. Each of the short portions 416 is formed with a lower hole 415 (i.e., the upper mounting 4 has two lower holes 415). In this embodiment, the upper mounting 4 has four internal blocks 44. Two of the internal blocks 44 are connected to one of the short portions 416, and the other two of the internal blocks 44 are connected to the other one of the short portions 416. Each of the internal blocks 44 has a block body 442 that is connected between the surrounding wall 42 and a corresponding short portion 416 of the bottom wall 41, and that defines a service space 441 disposed outside of the upper mounting 4 and being in communication with a respective one of the service openings 422. The block body 442 of each of the internal blocks 44 is formed with a support hole 443.

Figure 7:
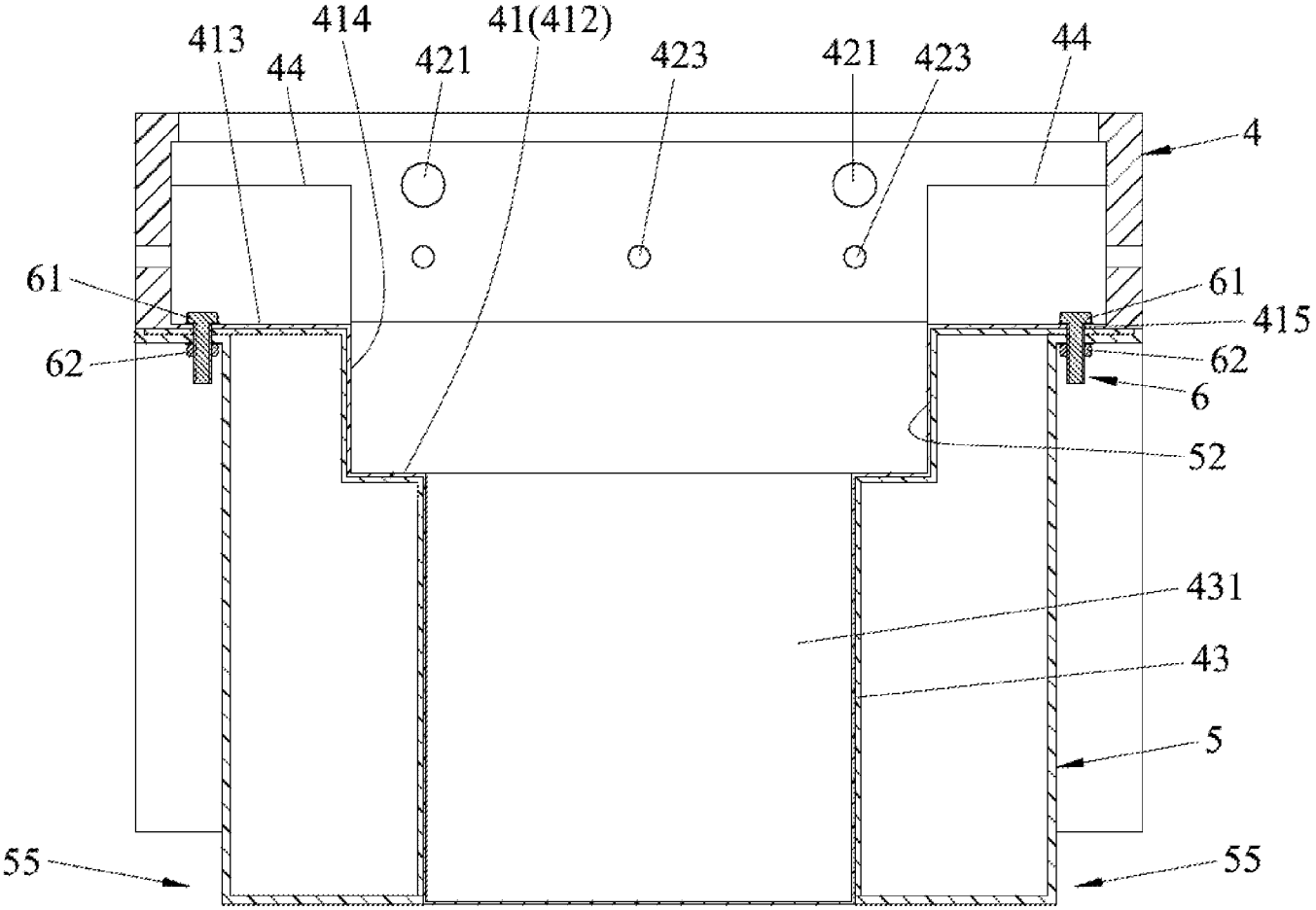
FIG. 7 is a sectional view taken along line VII-VII in FIG. 4.

Referring to FIGS. 4, 6, and 7, the lower mounting 5 further has a load bearing section 52 that has a top portion engaged with the upper mounting 4, and having a contour that corresponds in shape to a contour of bottom surfaces of the first wall section 412 and the shoulder section 414 of the bottom wall 41 of the upper mounting 4. The lower mounting 5 further has a root guide hole 53 that extends downwards from the load bearing section 52, and the extension wall 43 of the upper mounting 4 extends downwards from the peripheral edge of the root opening 411 of the bottom wall 41 into the root guide hole 53. In this embodiment, the contour of the bottom surface of the first walls section 412 is shaped as a rectangle. The lower mounting 5 further has a plurality of attachment holes 54 respectively corresponding in position to the lower holes 415 of the upper mounting 4, and a plurality of attachment troughs 55 being recessed from the outer surface of the lower mounting 5 and communicating respectively with the attachment holes 54.

In this embodiment, the attachment troughs 55 and the guiding troughs 51 extends in the third direction (X3), and each of the attachment troughs 55 has a length in the third direction (X3) larger than that of each of the guiding troughs 51. In this embodiment, there are twelve guiding troughs 51, but the number of guiding troughs 51 is not a limitation on the present disclosure. In other embodiments, the artificial floating island 1 may have any number of guiding troughs 51 extending to various lengths.

In this embodiment, the load bearing section 52 of the lower mounting 5 is rectangular, the root opening 411 of the upper mounting 4 is circular, and the extension wall 43 of the upper mounting 4 is tubular in shape. In certain embodiments, the contours of the first wall section 412 of the bottom wall 41 of the upper mounting 4 and the load bearing section 52 of the lower mounting 5 may be triangular, pentagonal or other polygonal shapes so as to prevent rotation of the upper mounting 4 relative to the lower mounting 5. In other embodiments, the root opening 411 of the upper mounting 4 and the corresponding root guide hole 53 of the lower mounting 5 may be polygonal while the extension wall 43 is in the shape of a prism, so as to prevent rotation of the upper mounting 4 relative to the lower mounting 5.

In this embodiment, there are two attachment holes 54. There are two attachment troughs 55, equal to the number of short portions 416 of the second wall section 413 of the upper mounting 4.

The artificial floating island 1 further includes a fastening unit 6. The fastening unit 6 includes a plurality of male fasteners 61 and a plurality of female fasteners 62. Each of the male fasteners 61 extends through a respective one of the lower holes 415 of the upper mounting 4 and a respective one of the attachment holes 54 of the lower mounting 5, and is removably engaged with a respective one of the female fasteners 62 so that the upper mounting 4 is removably coupled to the lower mounting 5.

Figure 3:
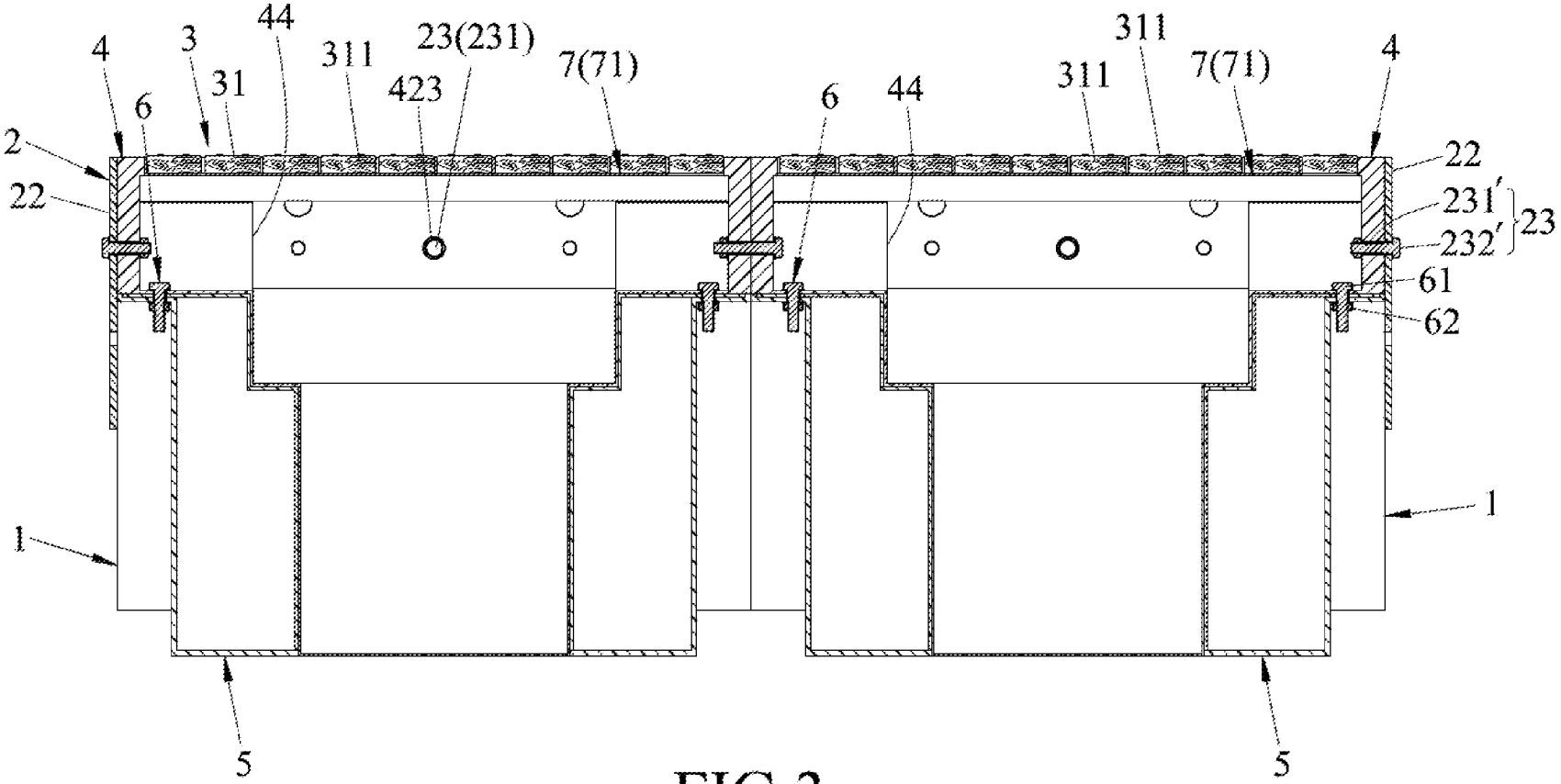
FIG. 3 is a sectional view taken along line III-III in FIG. 1.

In this embodiment, the fastening unit 6 includes two male fasteners 61 and two female fasteners 62. Referring to FIGS. 2, 3 and 4, the artificial floating island 1 of this embodiment further includes a bracing unit 7 that includes two bracing supports 71 disposed on the internal blocks 44 of the upper mounting 4. More specifically, each of the bracing supports 71 is coupled to the upper mounting 4 by being placed on top of two corresponding internal blocks 44.

Figure 8:
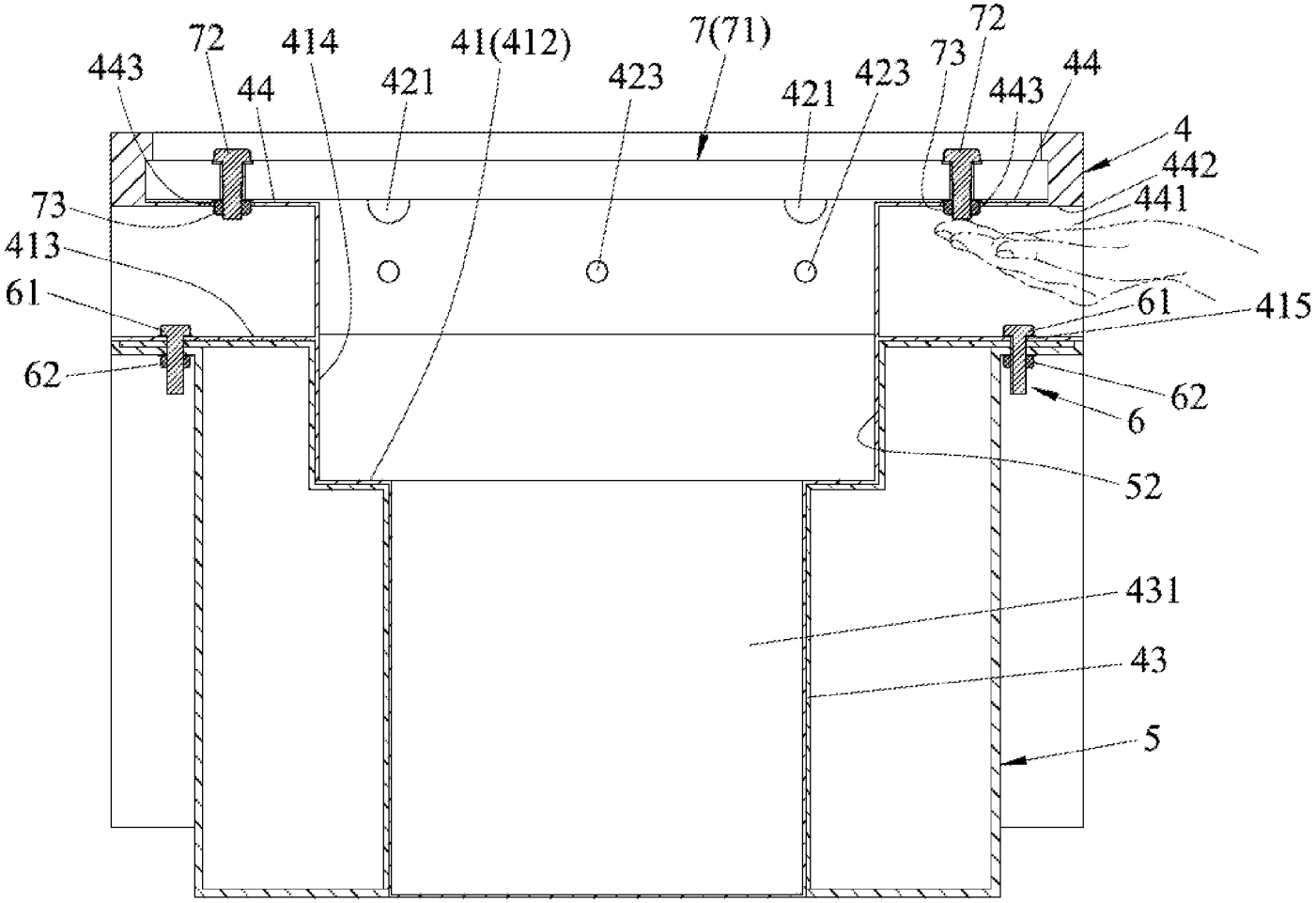
FIG. 8 is a sectional view taken along line VIII-VIII in FIG. 4

FIG. 8 shows an alternative implementation of the bracing supports 71. Specifically, the bracing unit 7 further includes a plurality of female bracing fasteners 73, and a plurality of male bracing fasteners 72. Each male bracing fastener 72 extends through a corresponding one of the bracing supports 71 and the support hole 443 of the block body 442 of a corresponding one of the internal blocks 44, and is removably engaged with a respective one of the female bracing fasteners 73 so that the bracing support 71 is removably secured to the upper mounting 4. It should be further noted that, a user's hand can reach into one of the service spaces 441 through the corresponding service opening 422 to secure an accessory to the upper mounting 4. In this embodiment, the accessory is the bracing support 71 which can be secured to the upper mounting 4 adjacent to the block body 442 and the service space 441; the service space 441 and the service opening 422 of the present disclosure provides easy access for installing of the accessories to the upper mounting 4.

In this embodiment, each of the bracing supports 71 are wooden planks.

The connecting unit 2 of the artificial floating island assembly includes at least one first board member 21 extending in the first direction (X1), at least one second board member 22 extending in a second direction (X2), and a connecting set 23. The at least one first board member 21 and the at least one second board member 22 are removably connected to at least two groups of the artificial floating islands 1.

Referring to FIGS. 1 and 2, in this embodiment, there are two first board members 21 and two second board members 22, and the two first board members 21 and two second board members 22 enclose and surround the artificial floating islands.

Each of the two first board members 21 has a plurality of first connecting holes 211, a first engaging slit 212 extending in the third direction (X3), and a plurality of first through holes 213. Each of the second board member 22 has a plurality of second connecting holes 221, a second engaging slit 222 extending in the third direction (X3), and a plurality of second through holes 223.

The first through holes 213 of the first board members 21 and the second through holes 223 of the second board members 22 are registered respectively with the root through holes 421 of the surrounding walls 42 of the upper mountings 4 of the artificial floating islands 1, and are adapted for extension of plant roots there through.

It should be noted that in this embodiment of the artificial floating island 1, the first board members 21 and the second board members 22 are substantially identical in structure, which reduces manufacturing costs of these two components.

Referring to FIG. 2, the connecting set 23 of the connecting unit 2 has a plurality of first female connecting fasteners 232, and a plurality of first male connecting fasteners 231. Each of the first male connecting fasteners 231 extends through a corresponding one of the first connecting holes 211 of the first board member 21 and the surrounding wall 42 of the upper mounting 4 of a corresponding one of the artificial floating islands 1, and is removably engaged with a respective one of the first female connecting fasteners 232. The connecting unit 2 further has a plurality of second female connecting fasteners 232' and a plurality of second male connecting fasteners 231', each extending through a corresponding one of the second connecting holes 221 of the second board member 22 and the surrounding wall 42 of the upper mounting 4 of a corresponding one of the artificial floating islands 1, and are removably engaged with a respective one of the second female connecting fasteners 232', so that the first board member 21 and the second board member 22 are removably secured to the surrounding walls 42 of the upper mountings 4 of the artificial floating islands 1.

Referring back to FIG. 1, the artificial floating island assembly further includes four flooring units 31. Each flooring unit 31 has a plurality of floor members 311. In this embodiment, each floor cover unit 31 couples with the surrounding wall 42 of the upper mounting 4 of a respective one of the artificial floating islands 1 (see FIG. 2).

In this embodiment, the floor members 311 and the bracing supports 71 are wooden planks. However, in other embodiments of the artificial floating island assembly, the floor covers 311 may be a metal grille, and the bracing support 71 may be a steel PFC (parallel flange channel, also known as C-channel).

Figure 9:
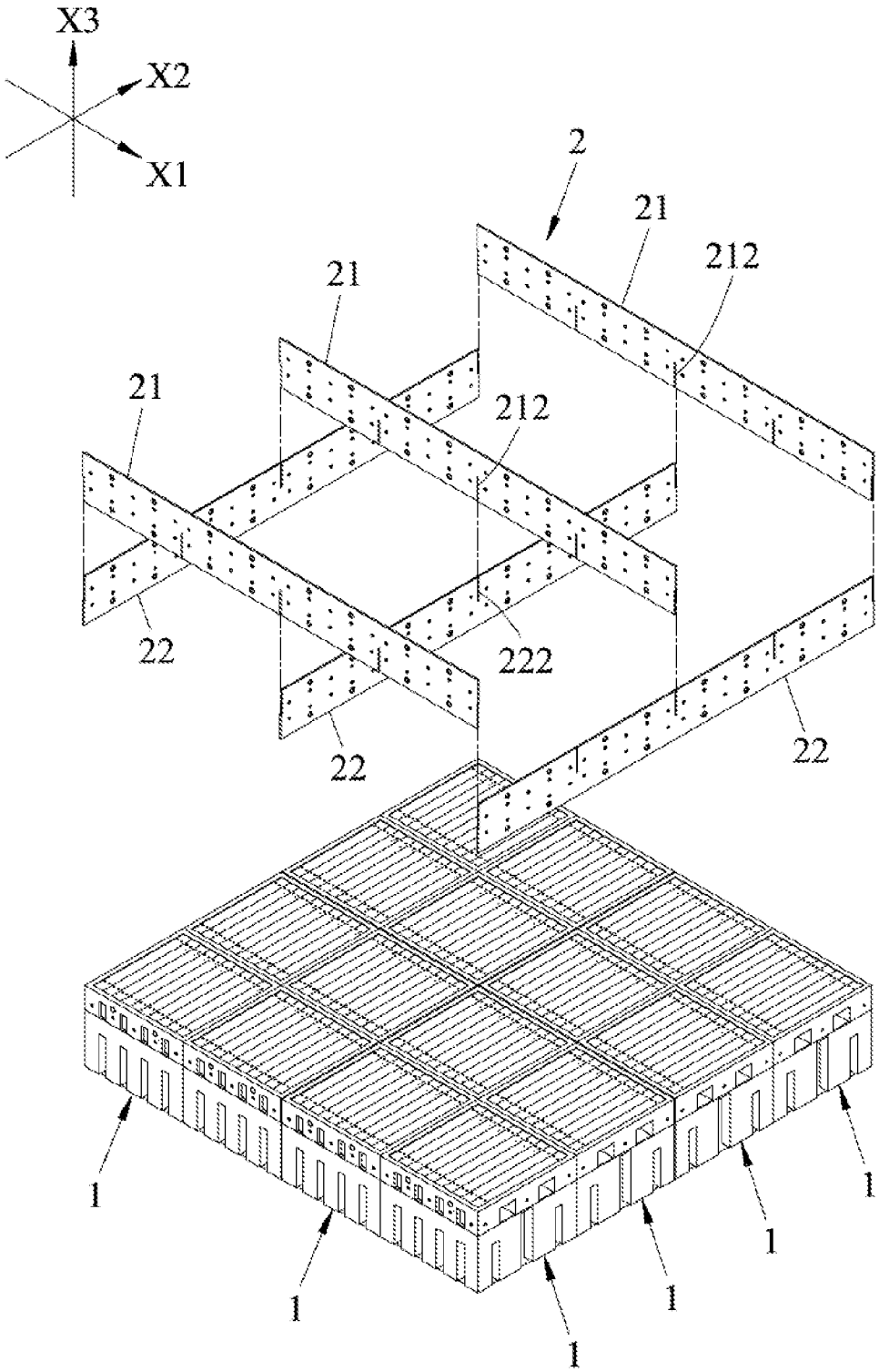
FIG. 9 is an exploded perspective view illustrating a variation of the first embodiment.

Referring to FIG. 9, showing a variation of the first embodiment of the floating island assembly, where the floating island assembly is expanded planarly in the first direction (X1) and the second direction (X2) to form an assembly of sixteen artificial floating islands 1. The variation of the first embodiment uses three first board members 21 and three second board members 22 to enclose and surround the outer surfaces of the artificial floating islands. Additionally, the first engaging slit 212 of the one of the first board members 21 that is located between the other two of the first board members 21 engages with the second engaging slit 222 of the one of the second board members 22 that is located between the other two of the second board members 22, so that the one of the first board members 21 is removably connected to the one of the second board members 22.

In summary of the above, the advantages of the first embodiment of the floating island assembly are summarized below:

1. By designing the artificial floating island 1 to include the service openings 422 in the surrounding wall 42, and the internal blocks 44 that define the service spaces 441, a user may switch the accessories on the artificial floating islands 1 without being required to disassemble the upper mountings 4 and the lower mountings 5. The user may switch accessories by passing his/her hand through the service openings 442 into the service spaces 441 and secure the accessories (in this embodiment the bracing support 71) to the adjacent block bodies 442.

2. Furthermore, for each artificial floating island 1, the guiding troughs 51 of the lower mounting 5 allows the artificial floating island 1 to evenly distribute and spread out any downward force applied to it (such as the weight of persons walking over the artificial floating island assembly or the weight of the accessories), which will increase stability and reduce roll, yaw, pitch, sway and surge of the artificial floating island assembly in an aquatic environment.

3. For each artificial floating island 1, the shapes of the first wall section 412, the root opening 411 and the extension wall 43 of the upper mounting 4, prevent the upper mounting 4 from rotating relative to the lower mounting 5, making it easier for the user to secure the upper mounting 4 to the lower mounting 5 via the fastening unit 6 and simplifying assembly procedure of the artificial floating island 1 and even the entire artificial floating island assembly.

Referring to FIGS. 10 to 13, a second embodiment of the artificial floating island assembly is shown. The second embodiment is broadly similar to the first embodiment, the only differences are: the assembly includes sixteen artificial floating islands 1 (same number as the variation of the first embodiment as illustrated in FIG. 9); the amount of the first board members 21 and the second board members 22 of the connecting unit 2 that are used; the method used to secure the bracing units 7; and the number of the flooring unit 31.

Figure 10:
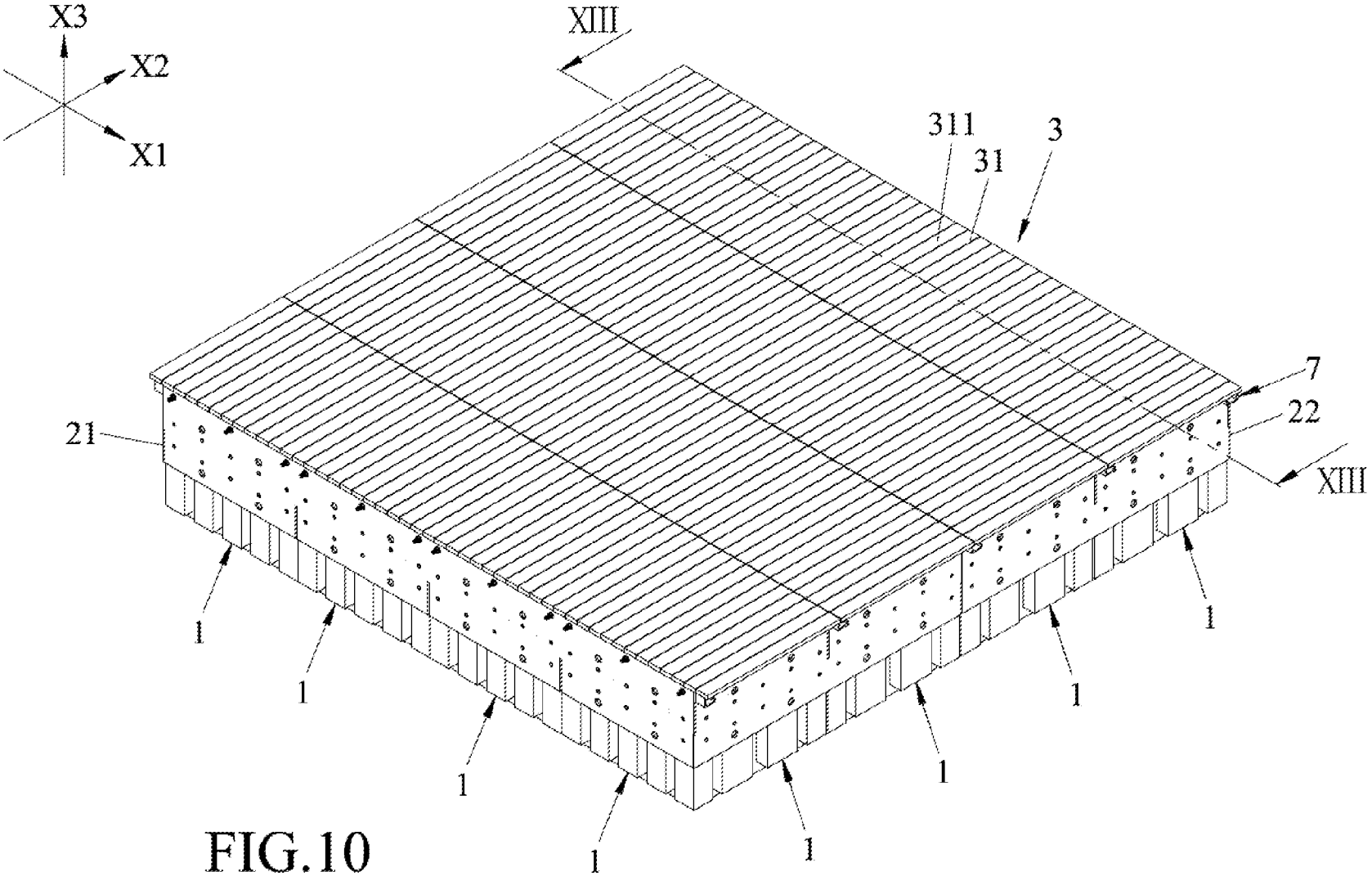
FIG. 10 is an assembled perspective view illustrating a second embodiment of the artificial floating island assembly according to the disclosure.
Figure 11:
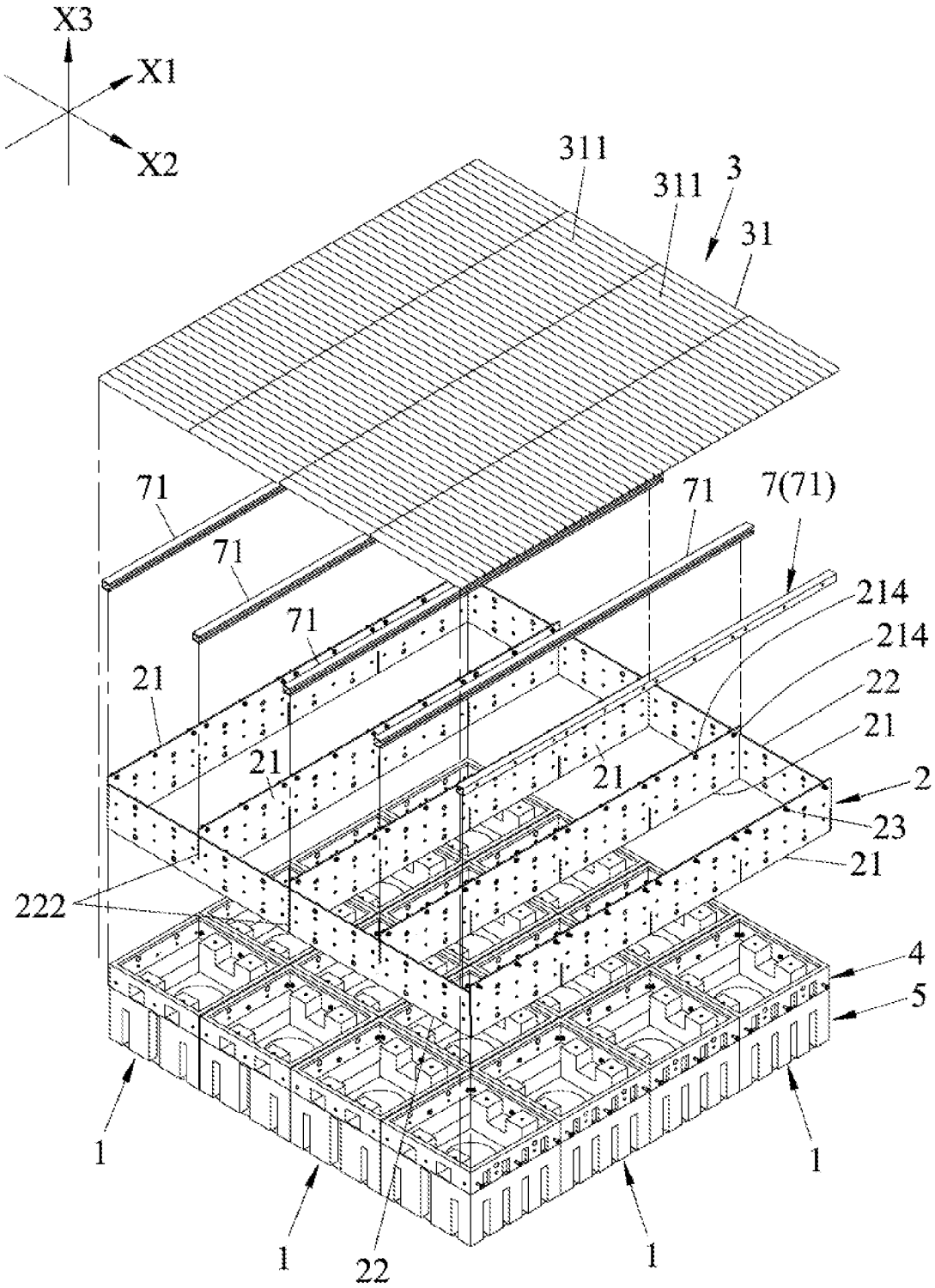
FIG. 11 is a partly exploded perspective view of the second embodiment.

Referring to FIGS. 10 and 11, the connecting unit 2 includes five first board members 21 and two second board members 22. The two outermost positioned first board members 21 and the two second board members 22 surround and enclose the artificial floating islands 1 that are on the periphery of the artificial island assembly, while the remaining three first board members 21 engage with the corresponding second engaging slit 222 of the second board member 22. Furthermore, each of the first board members 21 has a plurality of first engaging holes 214.

Figure 12:
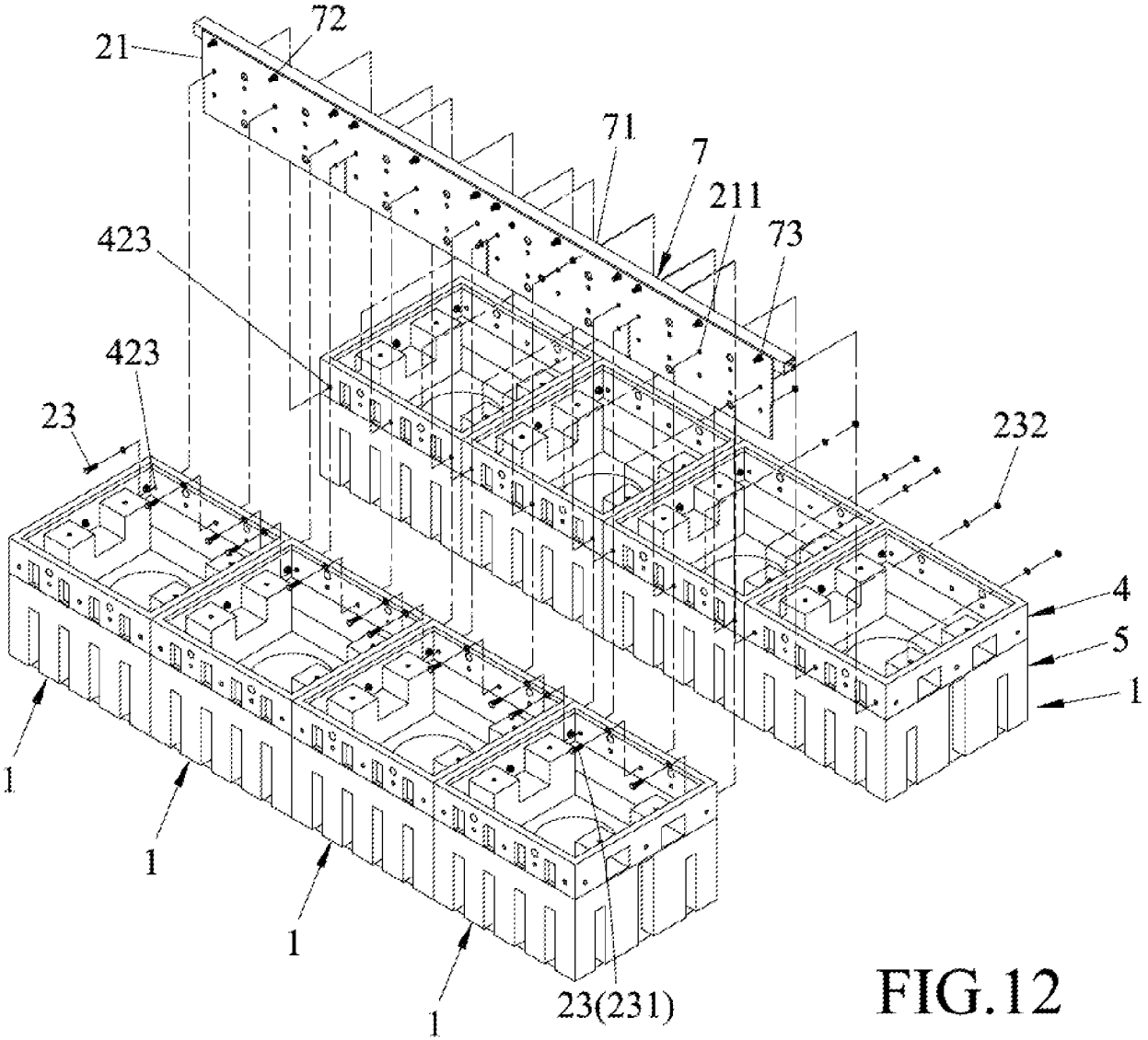
FIG. 12 is a fragmentary partly exploded perspective view illustrating the second embodiment.
Figure 13:
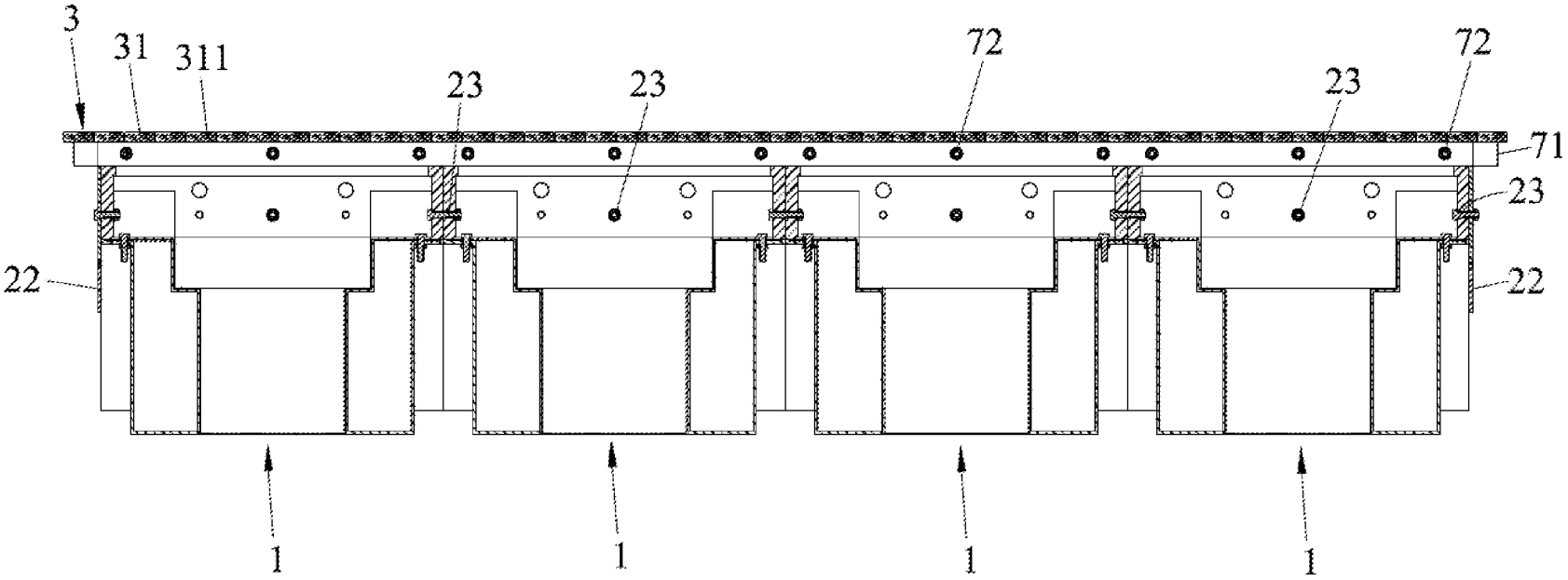
FIG. 13 is a sectional view taken along line XIII-XIII in FIG. 10.

Referring to FIG. 11, it should be noted that the height of each of the first board members 21 in the third direction (X3) is greater than the height of each of the second board members 22 in the third direction (X3). Referring further to FIG. 12, the connecting set 23 of the connecting unit 2, in addition to removably securing the two outermost first board members 21 and the two second board members 22 to the corresponding peripheral artificial floating islands 1 (in FIG. 10), also removably secures each intermediate first board member 21 in-between two adjacent rows of the artificial floating islands 1. More specifically, some of the first male connecting fasteners 231 extend through corresponding ones of the securing holes 423 of the artificial floating islands 1 in one row, the respective connecting holes 211 of the intermediate first board member 21 and corresponding ones of the securing holes 423 of the artificial floating islands 1 in the adjacent row. These first male connecting fasteners 231 are then removably secured with respective first female connecting fasteners 232 to secure the two rows of the artificial floating islands to the intermediate first board member 21.

In the second embodiment of the floating island assembly, the bracing unit 7 includes five bracing supports 71, a plurality of female bracing fasteners 73 and a plurality of male bracing fasteners 72. Each of the bracing supports 71 extends in the first direction (X1). Each of the male bracing fasteners 72 extends through a corresponding one of the first engaging holes 214 of a corresponding one of the first connecting board members 21 and a corresponding one of the bracing supports 71, and is removably engaged with a respective one of the female bracing fasteners 73 so that the bracing support 71 is removably secured to the first board member 21. In a variation of the second embodiment, the bracing supports 71 of the bracing unit 7 may extend in the second direction (X2), and be removably connected with the second board members 22 via the male bracing fasteners 72 and the female bracing fasteners 73.

In the second embodiment of the artificial floating island assembly, each of the bracing supports 71 is a steel PFC.

In the second embodiment of the artificial floating island assembly, there is only one flooring unit 31 that has floor members 311 which are covering over the bracing supports 71.

The second embodiment of the artificial floating island assembly, in addition to possessing all the advantages of the first embodiment, provides an alternative method of assembling the bracing units 7 and the flooring unit 31.

In the description above, for the purposes of explanation, numerous specific details have been set forth in order to provide a thorough understanding of the embodiments. It will be apparent, however, to one skilled in the art, that one or more other embodiments maybe practiced without some of these specific details. It should also be appreciated that reference throughout this specification to "other embodiment," "an embodiment," an embodiment with an indication of an ordinal number and so forth means that a particular feature, structure, or characteristic maybe included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An artificial floating island comprising:

an upper mounting that includes a bottom wall formed with a root opening, an extension wall extending downwards from a peripheral edge of said root opening of said bottom wall, and defining a root space that is in communication with said root opening, a surrounding wall extending upwards from a periphery of said bottom wall and cooperating with said bottom wall to define an internal space, said surrounding wall having a plurality of service openings, and a plurality of internal blocks, each having a block body that is connected between said bottom wall and said surrounding wall, and that defines a service space disposed outside of said upper mounting and being in communication with a respective one of said service openings; and a lower mounting that is coupled to said upper mounting, said lower and upper mountings being arranged in an up-down direction, said lower mounting having an outer surface that is formed with a plurality of guiding troughs;

wherein said bottom wall has:

a first wall section that is connected to a top end of said extension wall;

a second wall section that extends inwards from a bottom end of said surrounding wall and that is above said first wall section in the up-down direction; and a shoulder section that interconnects said first wall section and said second wall section.

2. The artificial floating island as claimed in claim 1, wherein said lower mounting further has:

a load bearing section that has a top portion engaged with said upper mounting, said top portion of said load bearing section having a contour that correspond in shape to a contour of bottom surfaces of said first wall section and said shoulder section of said bottom wall of said upper mounting; and a root guide hole that extends downwards from said load bearing section, said extension wall of said upper mounting extending downwards from said peripheral edge of said root opening of said bottom wall into said root guide hole.

3. The artificial floating island as claimed in claim 2, wherein the contour of said bottom surface of said first wall section is shaped as a rectangle.

4. An artificial floating island comprising:

an upper mounting that includes a bottom wall formed with a root opening, an extension wall extending downwards from a peripheral edge of said root opening of said bottom wall, and defining a root space that is in communication with said root opening, a surrounding wall extending upwards from a periphery of said bottom wall and cooperating with said bottom wall to define an internal space, said surrounding wall having a plurality of service openings, and a plurality of internal blocks, each having a block body that is connected between said bottom wall and said surrounding wall, and that defines a service space disposed outside of said upper mounting and being in communication with a respective one of said service openings; and a lower mounting that is coupled to said upper mounting, said lower and upper mountings being arranged in an up-down direction, said lower mounting having an outer surface that is formed with a plurality of guiding troughs;

wherein said upper mounting has a plurality of lower holes;

wherein said lower mounting further has a plurality of attachment holes respectively corresponding in position to said lower holes, and a plurality of attachment troughs being recessed from said outer surface of said lower mounting and communicating respectively with said attachment holes; and wherein said artificial floating island further comprises a fastening unit including a plurality of male fasteners and a plurality of female fasteners, each of said male fasteners extending through a respective one of said lower holes of said upper mounting and a respective one of said attachment holes of said lower mounting, and being removably engaged with a respective one of said female fasteners so that said upper mounting is removably coupled to said lower mounting.

5. The artificial floating island as claimed in claim 4, wherein:

said attachment troughs and said guiding troughs extends in the up-down direction; and each of said attachment troughs has a length in the up-down direction larger than that of each of said guiding troughs.

6. An artificial floating island comprising:

an upper mounting that includes a bottom wall formed with a root opening, an extension wall extending downwards from a peripheral edge of said root opening of said bottom wall, and defining a root space that is in communication with said root opening, a surrounding wall extending upwards from a periphery of said bottom wall and cooperating with said bottom wall to define an internal space, said surrounding wall having a plurality of service openings, and a plurality of internal blocks, each having a block body that is connected between said bottom wall and said surrounding wall, and that defines a service space disposed outside of said upper mounting and being in communication with a respective one of said service openings; and a lower mounting that is coupled to said upper mounting, said lower and upper mountings being arranged in an up-down direction, said lower mounting having an outer surface that is formed with a plurality of guiding troughs;

wherein said block body of each of said internal blocks is formed with a support hole; and wherein said artificial floating island further comprises a bracing unit that includes at least one bracing support, a plurality of female bracing fasteners, and a plurality of male bracing fasteners, each extending through said at least one bracing support and said support hole of said block body of a corresponding one of said internal blocks, and removably engaged with a respective one of said female bracing fasteners so that said at least one bracing support is removably secured to said upper mounting.

* * * * *